US005836554A

United States Patent [19]

Lesage

[11] Patent Number: 5,836,554

[45] Date of Patent: Nov. 17, 1998

[54] SUPPORT BASE FOR GAS WATER HEATERS

[75] Inventor: Claude Lesage, Pointe-Claire, Canada

[73] Assignee: Giant Factories Inc., Montreal, Canada

[21] Appl. No.: 667,474

[22] Filed: Jun. 21, 1996

[51] Int. Cl.[6] ..... A47G 23/02

[52] U.S. Cl. ..... 248/152; 126/363; 248/346.01

[58] Field of Search ..... 248/146, 154, 248/126, 127, 152, 346.01; 126/361, 363, 306; 122/14

[56] References Cited

U.S. PATENT DOCUMENTS

| | | | |
|---|---|---|---|
| 616,030 | 12/1898 | Stone | 126/361 |
| 3,163,159 | 12/1964 | Buehl et al. | 126/363 |
| 3,275,798 | 9/1966 | Martin | 126/361 |
| 4,932,621 | 6/1990 | Kowk | 248/146 |

*Primary Examiner*—Leslie A. Braun
*Assistant Examiner*—Gwendolyn Baxter
*Attorney, Agent, or Firm*—Swabey Ogilvy Renault; Guy J. Houle

[57] ABSTRACT

A support base for a gas water heater cylindrical housing is described. The base comprises a circular bottom dish having a flat bottom wall and a circumferential flange. A circumferential rounded edge is provided between the bottom wall and the flange. Air passages are defined about the circumferential flange. A circular housing support bottom wall, of larger diameter, is secured on the circumferential flange and has a central passage formed therein to admit air to a burner chamber supported on the bottom wall and through the air passages of the base wherein air currents are developed to cool the base when the burner is in use. The base therefore provides heat loss and further permits sliding and rolling displacement of the water heater cylindrical housing on a floor surface without damaging the floor surface due to the circumferential rounded edge of the base.

8 Claims, 2 Drawing Sheets

SUPPORT BASE FOR GAS WATER HEATERS

TECHNICAL FIELD

The present invention relates to a support base for a gas water heater housing and wherein the base is so constructed as to permit rolling displacement of the cylindrical housing on a floor surface without damaging the surface and further provides air convection and cooling means to the bottom end of the combustion chamber to prevent heat loss and to protect the floor surface from heat.

BACKGROUND ART

Various types of gas-fired water heater constructions are known. Most gas-fired water heaters consist of a large cylindrical housing formed of steel and usually supported at a bottom end by legs or by a steel ring to space the bottom wall from a support surface. Because these water heaters are fairly heavy it is customary to roll them on their circular bottom edges while supporting the housing at an inclined angle. Because these bottom edges are usually ring-shaped or have sharp corners they often will mark hardwood floors and damage other flooring materials due to the high load concentration on these sharp edges.

Another disadvantage of gas-fired water heaters is that often the bottom wall of the water heater becomes excessively hot and this can cause damage to floor surfaces, and particularly carpeted surfaces. The bases of these gas fired water heaters are also a source of heat loss.

SUMMARY OF INVENTION

It is therefore a feature of the present invention to provide a support base for a gas-fired water heater cylindrical housing and wherein the base is constructed to permit the displacement of the water heater by rolling same on a rounded support edge of a dish-like base. There are therefore no sharp corners about the circular base.

Another feature of the present invention is to provide a support base for a gas-fired water heater cylindrical housing and wherein the base provides air ventilation and cooling of the housing bottom wall above which is located the combustion chamber whereby to prevent heat loss and to cool the area of the support base to prevent heat damage to surrounding floor surfaces.

According to the above features, from a broad aspect, the present invention provides a support base for a gas-fired water heater housing. The base comprises a circular bottom dish having a flat bottom wall and a circumferential flange. A circumferential rounded edge is provided between the bottom wall and the circumferential flange. Air passage means is defined about the circumferential flange. A circular housing support bottom wall is secured on the circumferential flange and has further air passage means formed therein for admitting air to a burner chamber supported thereon and through the air passage means. The circular housing support bottom wall is adapted to secure the water heater housing thereto and spaced above a floor surface by the circular bottom dish. The circular bottom dish with the air passage means and the housing support bottom wall provide a heat shield for the floor surface and creates air convection to prevent heat loss. The circular bottom dish permits sliding and rolling displacement of the water heater cylindrical housing on a floor surface without damaging the floor surface.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
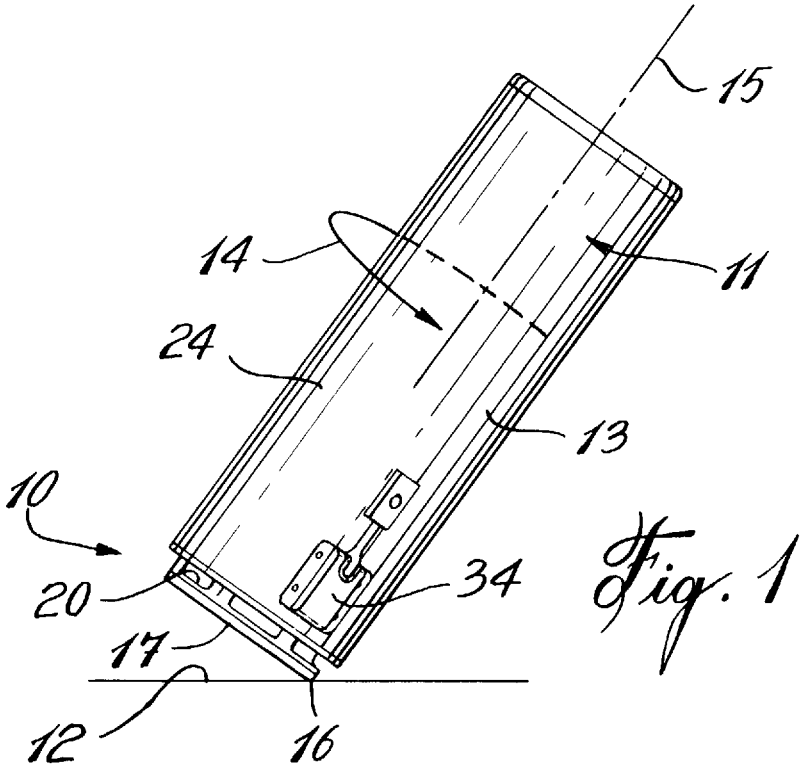
FIG. 1 is a perspective view showing a gas-fired water heater mounted with a support base of the present invention and being displaced by rotating the water heater in a tilted manner over the floor surface.

Referring now to the drawings and more particularly to FIG. 1, there is shown generally at 10 the support base of the present invention and secured to a cylindrical gas-fired water heater 11. As hereinshown the gas-fired water heater 11 is being displaced on a floor surface 12 by turning the cylindrical housing 13 of the gas-fired heater 11 in the direction of arrow 14 while tilting it along a convenient tilt axis 15. Accordingly, the entire weight of the water heater 11 will rest on an edge or corner 16 of the base 10. With the present invention this edge 16 is of rounded shape whereby not to damage the floor surface 12 on which the water heater is displaced.

Figure 2:
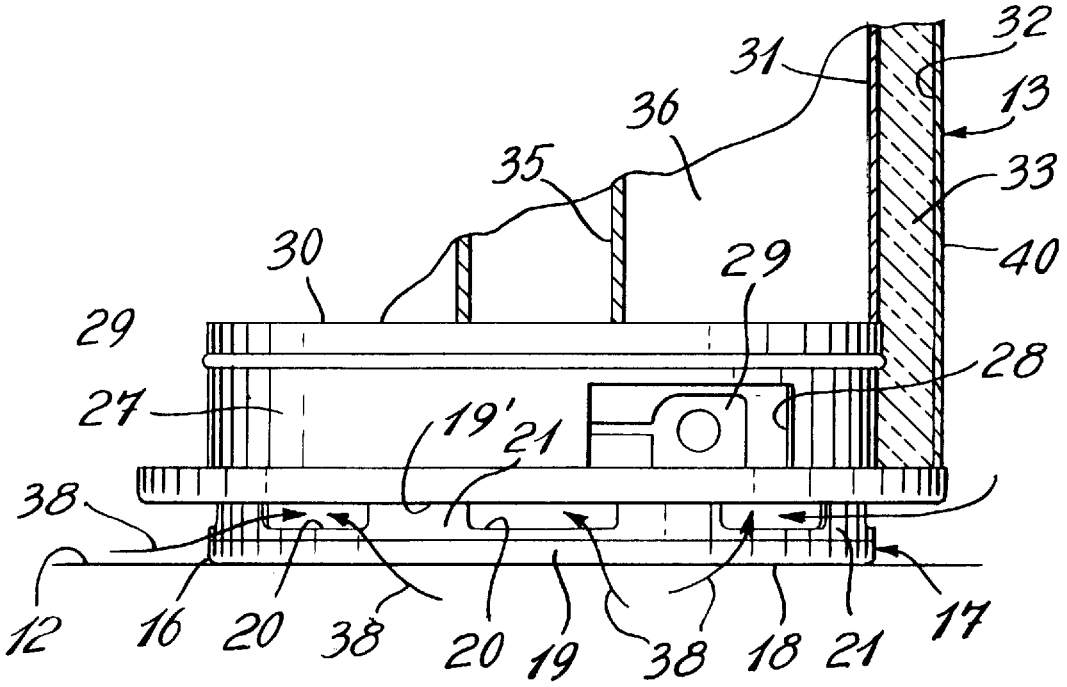
FIG. 2 fragmented section view showing the support base construction and part of the bottom end of a gas-fired water heater cylindrical housing.
Figure 3:
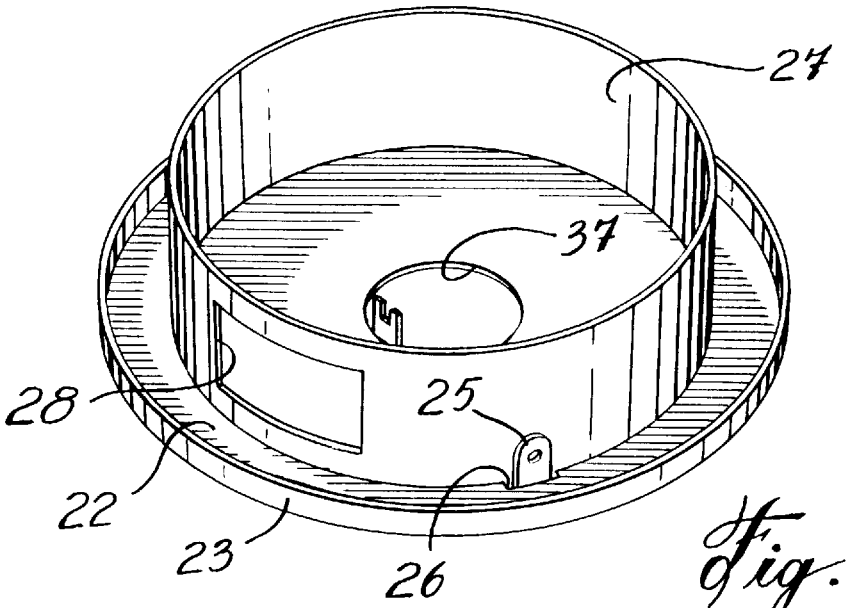
FIG. 3 a perspective view showing the support base with the burner chamber sleeve secured thereto.

With additional reference to FIGS. 2 to 5 there will now be described the construction of the support base 10 and its various features. As shown in FIGS. 2 and 3 the support base 10 is comprised of a circular bottom dish 17 having a flat bottom wall 18 and a circumferential flange 19. A circumferential rounded edge or corner 16, as better shown in FIG. 5, is formed between the bottom wall 18 and the flange 19. Air passage means 20 in the form of elongated cut-outs are defined about the circumferential flange. Support ribs 21 extend between the passages 20 whereby to support a circular housing support bottom wall 22 thereover, as better seen in FIG. 3. The air passage means 20 extend to the bottom wall 22 whereby air convection currents contact the bottom wall to cool it when the burner is operative.

Figure 4:
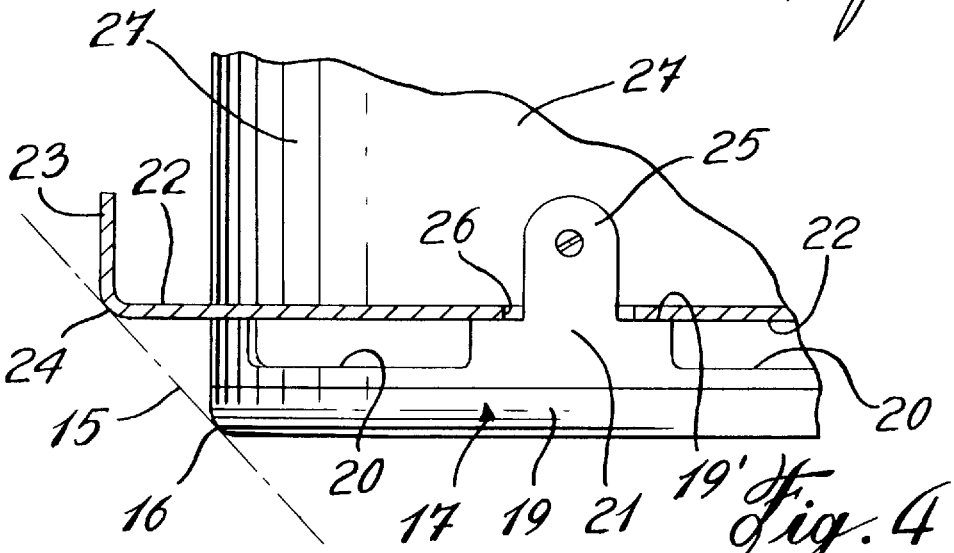
FIG. 4 a further fragmented section view showing further features of the support base of the present invention.
Figure 5:
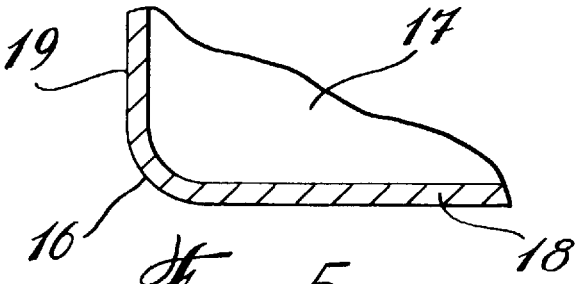
FIG. 5 is an enlarged section view showing the circumferential rounded edge of the support base.

With reference to FIGS. 2 and 4, it can be seen that the support bottom wall 22 has an integrally formed upwardly extending peripheral attachment flange 23. A further rounded edge 24 is formed between the flange 23 and the bottom wall 22 and also prevents damage to a floor surface should the water heater be further tilted so that the tilt axis 15 aligns with both rounded edges 16 and 24. This provides added protection to floor surfaces.

The circumferential flange 19 is also provided with two or more, herein four, extension tabs 25 which protrudes above the top edge 19' of the circumferential flange 19 and through corresponding slots 26 (see FIG. 3) formed in the housing support bottom wall 22 whereby to secure above said water heater a burner chamber circumferential sleeve 27. The sleeve 27 is provided with a port hole 28 for access to a burner assembly 29, as shown in FIG. 2.

With further reference to FIG. 2 it can also be seen that the burner chamber circumferential sleeve 27 has a support rib 29 formed thereabout and spaced from a top edge 30 thereof whereby to receive in support engagement the cylindrical inner casing 31 of the water heater and in spatial relationship to the outer casing 40 to define an insulating space 32 thereabout. A fireproof thermal insulating material 33 is disposed in this space and extends down to the support bottom wall 22 whereby to provide insulation about the burner chamber circumferential sleeve 27 and prevent heat loss. A trap door 34 is removably secured to the outer casing 40 adjacent the port hole 28 for access to the burner. The backside of this door 34 also contains insulation to insulate the port hole. As shown in FIG. 2, the burner inner casing is also provided with a central flue 35 through which hot gases from the burner escape and the walls of which act as a heat transfer element to heat water contained within the chamber 36 of the water heater inner casing 31.

As can be seen from FIGS. 2 and 4, the burner chamber sleeve 27 is of substantially the same diameter as the circular bottom dish 17 whereby the load of the inner casing 31 and its contents is distributed over the circumferential flange 19 through the support wall 22. The elements forming the base 10 are also constructed from steel sheeting material as well as the burner chamber circumferential sleeve 27 which constitutes a combustion chamber.

As shown in FIG. 3 the housing support bottom wall 22 is provided with a large circular hole 37 at the center thereof and aligned with the flue 35 supported thereabove. This hole 37 provides an air intake port for the gas burner assembly 29. When the gas burner is fired, air is pulled in through the hole 37 in the bottom wall and this causes a circumferential air convection stream about the support wall 22, as indicated by arrows 38 in FIG. 2. This air stream 38 cools the support bottom wall 22 as well as the dish 17. As hereinshown the support wall 22 is supported elevated from the floor surface 16 and also acts as a heat shield. The bottom wall 18 of the dish 17 also protects the floor from heat and it is also cooled by the air stream flowing about the base of the cylindrical housing 13.

It is within the ambit of the present invention to cover any obvious modifications of the example of the preferred embodiment described herein, provided such modifications fall within the scope of the appended claims.

I claim:

1. A support base for a gas-fired water heater tank, said base comprising a circular bottom dish having a flat bottom support wall and a tank supporting circumferential flange wall, a circumferential rounded edge between said bottom wall and circumferential flange wall, air passage means disposed spaced apart about said circumferential flange wall, a circular housing-support bottom wall secured on top of said circumferential flange wall and having further air passage means formed therein for admitting air to a burner chamber formed thereover by a circumferential sleeve secured and supported thereon and through said air passage means of said circumferential flange wall, said air passage means disposed about said circumferential flange wall being closely spaced to said circular housing-support bottom wall to cause a cooling circumferential air convection stream to cool said housing support-bottom wall, said circular housing-support bottom wall being adapted to secure said water heater tank thereto with said housing-support bottom wall spaced above a floor surface by said circular bottom dish, said circular bottom dish with said air passage means and said housing-support bottom wall providing a heat shield for said floor surface said air passage means creating said air convection stream to also prevent heat loss through said support base, said circular bottom dish permitting sliding and rolling displacement of said water heater tank on said floor surface without damage to said floor surface.

2. A support base as claimed in claim 1 wherein said circular bottom dish is a metal dish, said circumferential flange wall having a plurality of elongated openings formed thereabout and in registry with said housing-support bottom wall and constituting said air passage means, and two or more extension tabs protruding above said circumferential flange wall and through a corresponding slot formed in said housing support bottom wall for securing said circumferential sleeve above said housing support bottom wall, said sleeve having a water heater inner casing securable to a top edge portion thereof, said sleeve being dimensioned to accommodate a burner assembly therein.

3. A support base as claimed in claim 2 wherein said sleeve is provided with an access port for access to said burner assembly, said sleeve being of circular shape and of smaller diameter than said housing support bottom wall.

4. A support base as claimed in claim 3 wherein said housing support bottom wall has an upwardly extending peripheral attachment flange for securing an outer casing of said water heater spaced from said inner casing to accommodate a fireproof thermal insulating material thereabout, said insulating material also extending about said sleeve to said bottom wall.

5. A support base as claimed in claim 4 wherein said burner chamber sleeve is of substantially the same diameter as said circular bottom dish whereby the load of said inner casing and contents is distributed over said circumferential flange of said circular bottom dish and said circumferential rounded edge.

6. A support base as claimed in claim 2 wherein said further air passage means is a large central hole formed in said housing support bottom wall.

7. A support base as claimed in claim 2 wherein said burner chamber sleeve is a steel sleeve constituting a combustion chamber for burner assembly, said elongated openings of said circumferential flange extending in contact with portions of said housing support bottom wall to cool said bottom wall by creating said air convection stream thereabout.

8. A support base as claimed in claim 3 wherein said housing support bottom wall attachment flange is integrally formed with said support bottom wall and defines a further circumferential rounded edge therebetween.

* * * * *